US007634832B2

(12) United States Patent
Kawai

(10) Patent No.: US 7,634,832 B2
(45) Date of Patent: Dec. 22, 2009

(54) BRIDGE SLEEPER SUPPORTING PAD

(75) Inventor: Shoji Kawai, Nagoya (JP)

(73) Assignee: Daiwa Gravure Co., Ltd., Aichi (JP)

( * ) Notice: Subject to any disclaimer, the term of this patent is extended or adjusted under 35 U.S.C. 154(b) by 161 days.

(21) Appl. No.: 11/701,188

(22) Filed: Feb. 1, 2007

(65) Prior Publication Data

US 2008/0115298 A1 May 22, 2008

(30) Foreign Application Priority Data

Nov. 20, 2006 (JP) ..... 2006-312318

(51) Int. Cl.
*E04B 1/36* (2006.01)
*E01D 19/04* (2006.01)

(52) U.S. Cl. ..... 14/73.5

(58) Field of Classification Search ..... 14/73.5; 52/167.6, 167.8, 741.15
See application file for complete search history.

(56) References Cited

U.S. PATENT DOCUMENTS 4,120,164 A * 10/1978 Tomlin ..... 405/289
4,462,224 A 7/1984 Dunshee et al.
5,454,866 A * 10/1995 Gilbert et al. ..... 106/695
5,494,190 A 2/1996 Boettcher
6,186,998 B1 2/2001 Inuzuka et al.
6,491,159 B2 12/2002 Shibata
6,743,451 B2 * 6/2004 Rasile et al. ..... 426/112
7,293,646 B2 11/2007 Masuda et al.

FOREIGN PATENT DOCUMENTS

EP 82132 A2 * 6/1983

* cited by examiner

*Primary Examiner*—Sunil Singh
(74) *Attorney, Agent, or Firm*—Fildes & Outland, P.C.

(57) ABSTRACT

The invention aims at providing a bridge sleeper supporting pad for eliminating necessity of a recess to fit a projection of a rivet of a bridge beam, on a back face of a bridge sleeper or enhancing plate. For this, the invention provides a bridge sleeper supporting pad interposed between a bridge beam and bridge sleeper, including a main bag, first inner bag and second inner bag in the main bag, wherein the first inner bag contains a first reaction solution, the second inner bag contains a second reaction solution, the respective first and second inner bags are designed so that at least a part thereof opens under external pressure, the main bag is provided in communication with a sub bag, and the sub bag includes a plurality of compartments formed therein, the respective compartments partitioned by a sealed portion having a sealed portion with an inside easily peeled.

1 Claim, 13 Drawing Sheets

BRIDGE SLEEPER SUPPORTING PAD

BACKGROUND OF THE INVENTION

1. Field of the Invention

The present invention relates to a bridge sleeper supporting pad to be interposed between a bridge beam and a bridge sleeper so as to receive the bridge sleeper laid on the bridge beam in a railway track.

2. Description of the Related Art

As disclosed in Japanese Unexamined Patent Publication JP-A 2005-113984, a bridge sleeper adapted for placement on a bridge beam having a rivet has been conventionally known.

As disclosed in JP-A 2005-113984, it is necessary to form a recess tailored to fit with a projection of the rivet on a top end of the bridge beam on a back face of the bridge sleeper, which requires a lot of labor in processing.

Also known is a bridge sleeper in which an enhancing plate made of wood is fitted into a back face of the bridge sleeper at a position where it is laid on a bridge beam, in such a manner that substantially a half of a thickness of the enhancing plate projects downward from the bridge sleeper, and this enhancing plate is laid in abutment with the bridge beam. However, also on the back face of the enhancing plate, it is necessary to form a recess tailored to fit with a projection of a rivet on a top end of the bridge beam, so that time and labor are required in processing. In replacing with a new enhancing plate when the enhancing plate decays from the back face, it is necessary to form a recess tailored to fit with the projection of the rivet of the bridge beam on the back face of the new enhancing plate, so that it also takes time and labor in processing.

SUMMARY OF THE INVENTION

The present invention resolves such a problem, and it is an object of the present invention to provide a bridge sleeper supporting pad for eliminating a necessity of forming a recess tailored to fit with a projection of a rivet of a bridge beam on a back face of a bridge sleeper or enhancing plate.

In order to achieve this object, subject matters of the present invention are as follows.

1. A bridge sleeper supporting pad to be interposed between a bridge beam and a bridge sleeper, wherein in a main bag produced by using a synthetic resin sheet as a material, a first reaction solution as a base material and a second reaction solution as a curing agent are accommodated, external pressure from outside the main bag causes the first reaction solution and the second reaction solution to be mixed each other, the main bag is provided with a sub bag in a communicative manner, the sub bag includes a plurality of compartments formed therein, and the neighboring compartments are communicable each other.
2. The bridge sleeper supporting pad according to 1, wherein the compartments of the sub bag are partitioned by a sealed portion having an easily peeled sealed portion.
3. The bridge sleeper supporting pad according to 1, wherein each of the compartments of the sub bag is divided into two halves by an easily peeled sealed portion at a middle part of the each compartment, and the neighboring compartments communicate each other via a path formed in the sealed portion on a downstream position of the each compartment.
4. The bridge sleeper supporting pad according to 1, wherein an inner bag is provided in the main bag, the inner bag being made from the synthetic resin sheet and designed so that at least a part thereof opens under application of the external pressure, the main bag contains one of the first reaction solution as the base material and the second reaction solution as the curing agent, and the inner bag provided in the main bag contains one of the second reaction solution as the curing agent and the first reaction solution as the base material.
5. The bridge sleeper supporting pad according to 2, wherein an inner bag is provided in the main bag, the inner bag being made from the synthetic resin sheet and designed so that at least a part thereof opens under application of the external pressure, the main bag contains one of the first reaction solution as the base material and the second reaction solution as the curing agent, and the inner bag provided in the main bag contains one of the second reaction solution as the curing agent and the first reaction solution as the base material.
6. The bridge sleeper supporting pad according to 3, wherein an inner bag is provided in the main bag, the inner bag being made from the synthetic resin sheet and designed so that at least a part thereof opens under application of the external pressure, the main bag contains one of the first reaction solution as the base material and the second reaction solution as the curing agent, and the inner bag provided in the main bag contains one of the second reaction solution as the curing agent and the first reaction solution as the base material.
7. The bridge sleeper supporting pad according to 1, wherein a first inner bag and a second inner bag are provided in the main bag, each of the first and second inner bags being made from the synthetic resin sheet and designed so that at least a part thereof opens under application of the external pressure, the first inner bag contains the first reaction solution as the base material, and the second inner bag contains the second reaction solution as the curing agent.
8. The bridge sleeper supporting pad according to 2, wherein a first inner bag and a second inner bag are provided in the main bag, each of the first and second inner bags being made from the synthetic resin sheet and designed so that at least a part thereof opens under application of the external pressure, the first inner bag contains the first reaction solution as the base material, and the second inner bag contains the second reaction solution as the curing agent.
9. The bridge sleeper supporting pad according to 3, wherein a first inner bag and a second inner bag are provided in the main bag, each of the first and second inner bags being made from the synthetic resin sheet and designed so that at least a part thereof opens under application of the external pressure, the first inner bag contains the first reaction solution as the base material, and the second inner bag contains the second reaction solution as the curing agent.

According to the bridge sleeper supporting pad of the above configuration, the external pressure applied from outside the main bag allows curing of the mixture solution of the first reaction solution and the second reaction solution in the main bag, and excess compounds of the first reaction solution and the second reaction solution can be introduced to the sub bag, so that the thickness of the bridge sleeper supporting pad can be adjusted to a desired thickness. Even when there is the projection of the rivet on the top face of the bridge beam, by interposing the bridge sleeper supporting pad between the bridge beam and the bridge sleeper, it is possible to make the bridge sleeper supporting pad adapt to the projection of the rivet, so that there is no need to form the recess suited for the projection of the rivet of the bridge beam on the back face of the bridge sleeper or enhancing plate. Further, by forming the plurality of compartments partitioned by the sealed portion with the inside thereof being easily peeled, when a load of the bridge sleeper or rail is applied on the bridge sleeper supporting pad, the bridge sleeper supporting pad is strongly pressed, and unnecessary compounds of the first reaction solution and the second reaction solution tend to flow into the sub bag as a surplus. At this time, a pressure of the unnecessary compounds of the first reaction solution and the second reaction solution exerted on the sealed portion causes the sealed portion to open and sequentially pushes open the compartments, whereby the unnecessary compounds of the first reaction solution and the second reaction solution can be removed from the main bag.

DESCRIPTION OF THE PREFERRED EMBODIMENTS

Figure 1:
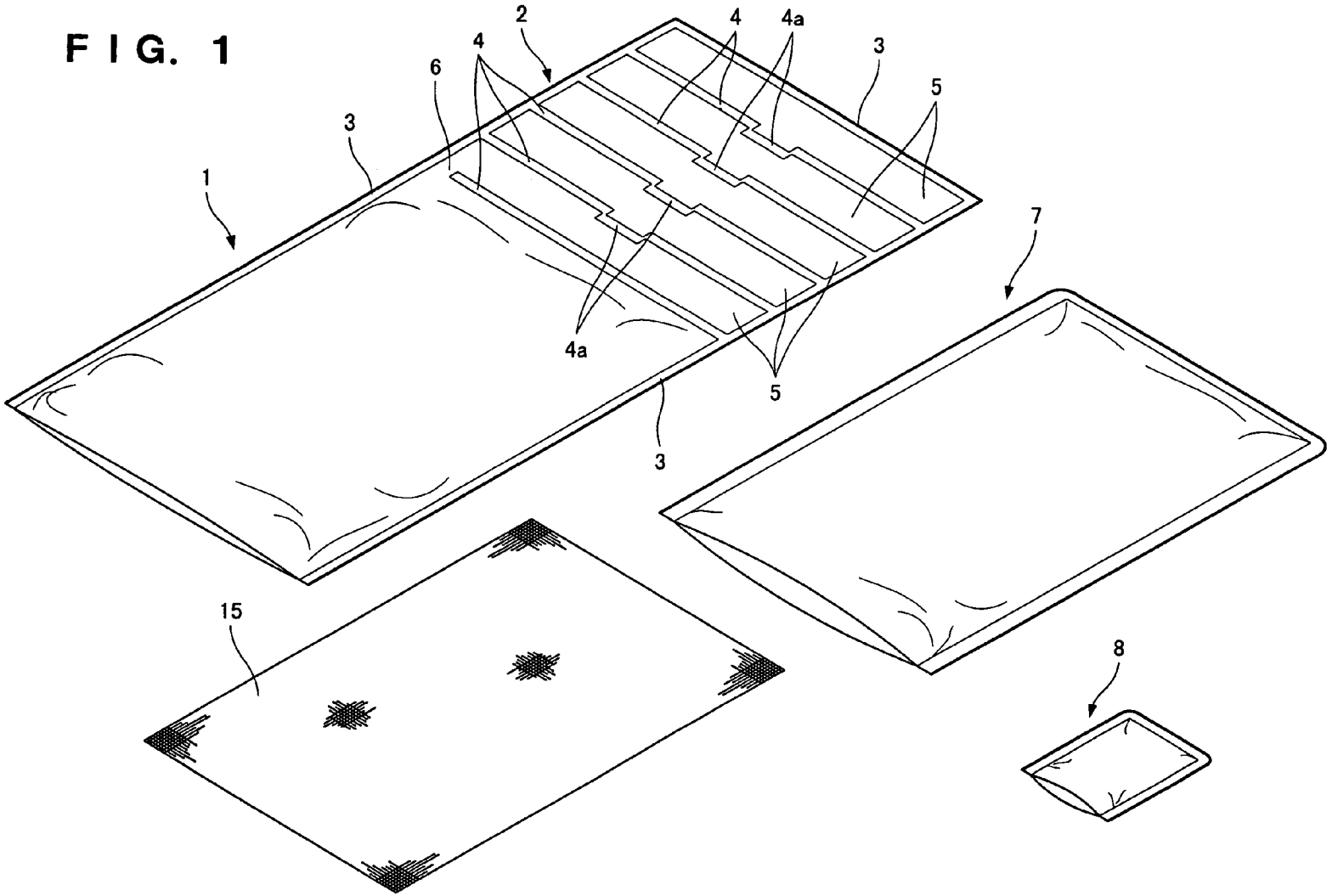
FIG. 1 shows exploded perspective views of a main bag, a first inner bag, a second inner bag, and a glass fiber cloth constituting a bridge sleeper supporting pad in a first embodiment of the present invention.
Figure 2A:
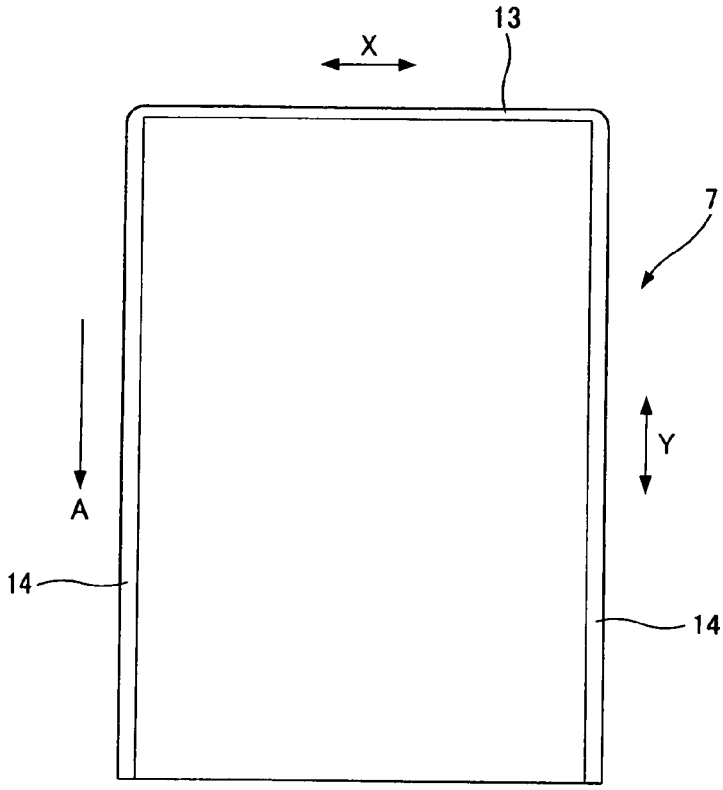
FIG. 2A shows a plan view of the first inner bag.
Figure 2B:
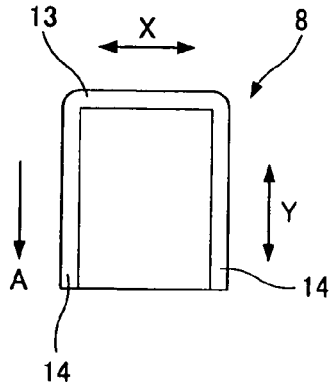
FIG. 2B shows a plan view of the second inner bag.
Figure 3:
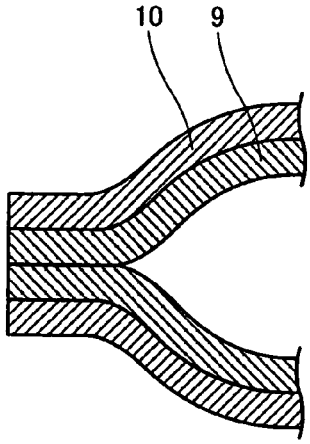
FIG. 3 shows an enlarged section view of the first or second inner bag.

FIGS. 1 to 11 illustrate a first embodiment of the preset invention.

In FIGS. 1 to 11, a main bag 1 has a rectangular planar shape, and a sub bag 2 is integrally provided in continuation with a long side of the main bag 1. A heat sealed portion 3 closes four peripheral sides. In terms of volume, the main bag 1 is made larger than the sub bag 2, and in the sub bag 2 a plurality of compartments 5 partitioned in a longitudinal direction of the main bag 1 by a sealed portion 4 are formed. The closest compartment 5 to the main bag 1 is separate from the main bag 1, and one end of the sealed portion 4 dividing the compartment 5 from the main bag 1 is separate from one heat sealed portion 3 on the long side, and whereby a path 6 allowing communication between the main bag 1 and the sub bag 2 is formed. A middle part of the sealed portion 4 between the neighboring compartments 5, 5 is formed as an easily peeled sealed portion 4*a* so as to project toward the compartment 5 positioned upstream.

The main bag 1 accommodates a first inner bag 7 having almost the same dimension as the inside of the main bag 1 and a second inner bag 8 smaller than the first inner bag 7. The above main bag 1 integral with the sub bag 2, the first inner bag 7 and the second inner bag 8 are made from a synthetic resin sheet.

The first and the second inner bags 7 and 8 also have a rectangular planer shape as is the case with the main bag 1, and produced by sealing four sides. Among the main bag 1 (including the continuing sub bag 2), the first and the second inner bags 7 and 8, the main bag 1 is formed of commonly used sheet materials such that an inner layer is formed of a film material having low melting point, such as polyethylene and an outer layer is formed of a film material having higher melting point than the inner layer, such as nylon, and produced by heat sealing the inner layers of the two sheet materials at their four sides.

Figure 4:
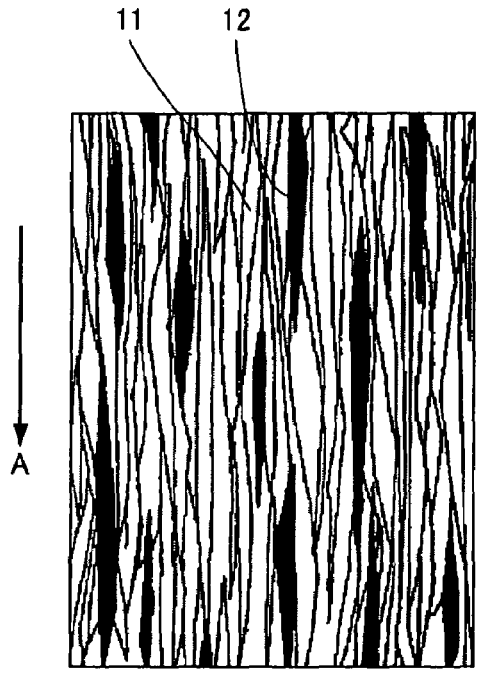
FIG. 4 shows an explanatory view illustrating orientation of resin.
Figure 5:
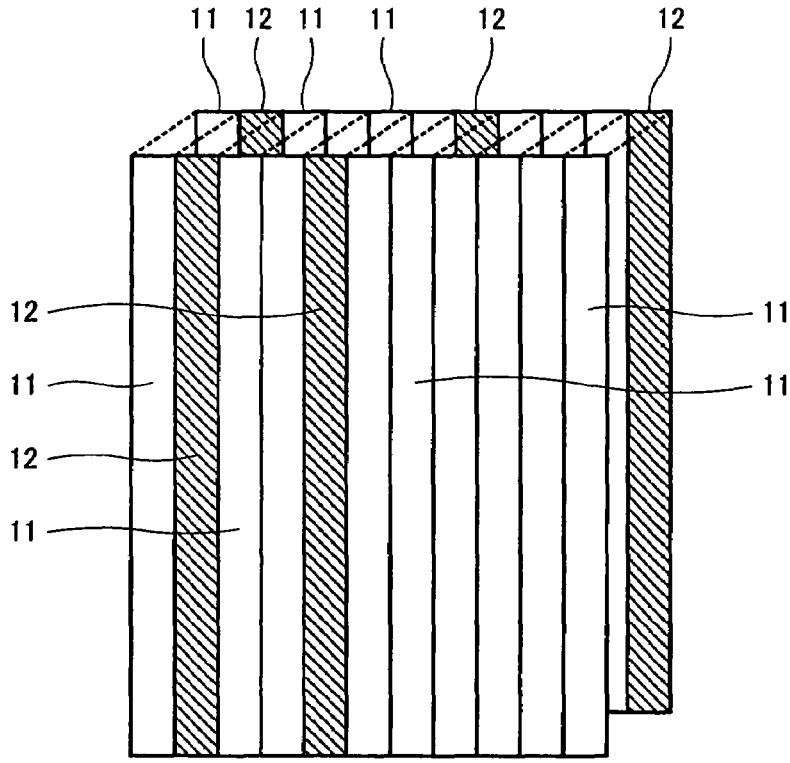
FIG. 5 shows an explanatory view illustrating a combined state of a resin part of straight-chain low-density polyethylene and a resin part of polybutane-1 in a heat sealed portion.

As is the case with the main bag 1, the first and the second inner bags 7 and 8 are basically made of an inner layer formed from a film material having low melting point, and an outer layer formed from a film material having higher melting point than the inner layer, however, the film material forming the inner layer 9 is made by blending straight-chain low-density polyethylene and polybutene-1, as the straight-chain low-density polyethylene, those having a density ranging from 0.915 to 0.950 are used, and a ratio of blending straight-chain low-density polyethylene and polybutene-1 is set within a range of 70:30 to 98:2. And it is found that, when the first and the second inner bag 7 and 8 are produced by heat sealing using the film material obtained by blending straight-chain low-density polyethylene and polybutene-1, a difference arises in sealing strength between a heat sealed portion in a direction (X) extending perpendicularly to a film flow direction (direction of an arrow A) and a heat sealed portion in a direction (Y) extending parallel with the film flow direction (direction of the arrow A). In other words, the strength in a width direction along the film flow direction (direction of the arrow A) of the heat sealed portion in the perpendicular direction (X) tends to be smaller than the strength in the width direction extending perpendicularly to the film flow direction (direction of the arrow A) of the heat sealed portion in the parallel direction (Y). This is ascribable to the following facts. The resin to be a material for the inner layer 9 of the first and the second inner bags 7 and 8 is obtained by blending straight-chain low-density polyethylene and polybutene-1. In laminating the inner layer 9 of a film material obtained by blending and the outer layer 10 formed of nylon or polyethyleneterephthalate, uniaxial orientation appears between straight-chain low-density polyethylene and polybutene-1 under action of a processing speed. In other words, a film is formed while the resin of straight-chain low-density polyethylene and the resin of polybutene-1 are irregularly aligned. This state is shown in FIG. 4 illustrating resin 11 of straight-chain low-density polyethylene and resin 12 of polybutene-1. In this manner, since the inner layer 9 has uniaxial orientation, when two film materials each having a bilayer structure are overlaid and the peripheries are heat sealed so as to produce the four-side sealed inner bags 7 and 8, as shown in FIG. 5, three patterns of facing combination are provided: a straight-chain low-density polyethylene resin part 11 and a straight-chain low-density polyethylene resin part 12; a polybutene-1 resin part 12 and a polybutene-1 resin part 12; and a straight-chain low-density polyethylene resin part 11 and a polybutene-1 resin part 12. Since the same kinds of resins are heat sealed in the combination of the straight-chain low-density polyethylene resin part 11 and the straight-chain low-density polyethylene resin part 11, and in the combination of the polybutene-1 resin part 12 and the polybutene-1 resin part 12, heat sealing strength is obtained within characteristics of the resin. On the contrary, in a part where the straight-chain low-density polyethylene resin part 11 and the polybutene-1 resin part 12 oppose each other, different kinds of resins face each other, so that heat sealing strengths of individual characteristics are not revealed. Such conditions are mixed in the heat sealing face. Heat seal characteristics coming from uniaxial orientation and the above three patterns of combination, and heat sealing direction cause the following phenomenon.

Figure 6:
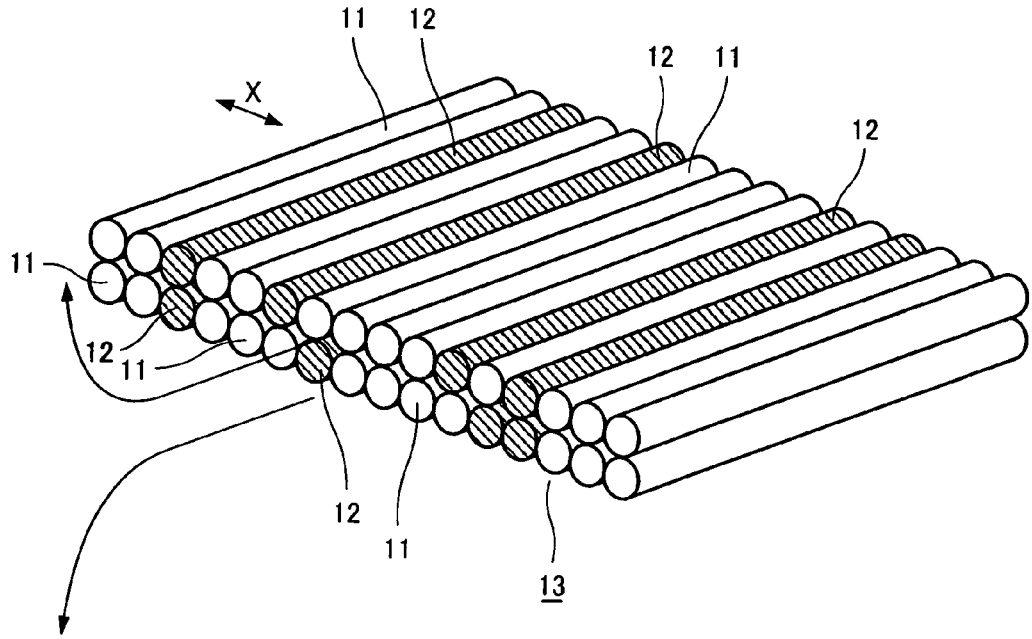
FIG. 6 shows an enlarged view of a relevant part of a sealing edge of the heat sealed portion on a short side.
Figure 7:
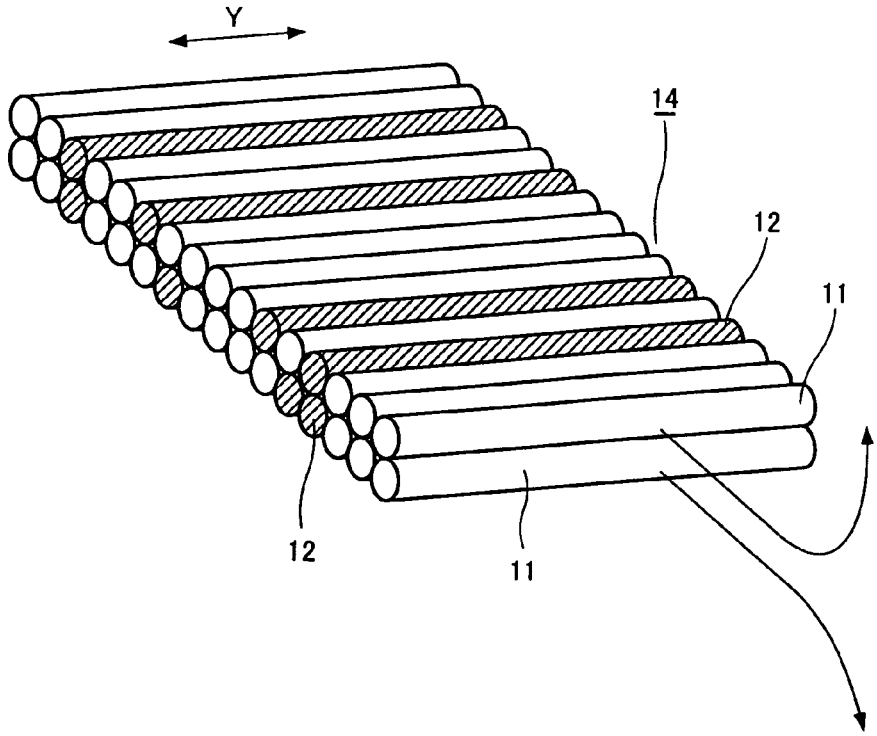
FIG. 7 shows an enlarged view of a relevant part of the sealing edge of the heat sealed portion on a long side.

In a sealing edge in the width direction along the film flow direction (direction of the arrow A) of the heat sealed portion in the direction (X) perpendicular to the film flow direction (direction of the arrow A), the above three patterns of combinations appear irregularly (see FIG. 6). On the other hand, in the sealing edge in the width direction extending perpendicularly to the film flow direction (direction of the arrow A) of the heat sealed portion in the direction (Y) parallel to the film flow direction (direction of the arrow A), either one of the three patterns of combinations appears (see FIG. 7).

In measurement of the heat sealing strength, it is well known that a sealing width of an object is in direct proportion to strength, and the wider the sealing width, the larger strength the object has. In the sealing edge in the width direction along the film flow direction (direction of the arrow A) of the heat sealed portion in the direction (X) perpendicular to the film flow direction (direction of the arrow A), since the three patterns of combinations appear irregularly, a percentage in the sealing width occupied by the combination of the straight-chain low-density polyethylene resin part 11 and the straight-chain low-density polyethylene resin part 11, and the combination of the polybutene-1 resin part 12 and the polybutene-1 resin part 12 increasing the strength is less than 100%, and presence of the combination of the straight-chain low-density polyethylene resin part 11 and the polybutene-1 resin part 12 in the sealing edge decreases the heat sealing strength. In the width direction extending perpendicularly to the film flow direction (direction of the arrow A) of the heat sealed portion in the direction (Y) parallel to the film flow direction (direction of the arrow A), since molecules are oriented uniaxially, there arise three cases of appearances: the combination of the straight-chain low-density polyethylene resin part 11 and the straight-chain low-density polyethylene resin 11 appears on the heat sealing edge, the combination of the polybutene-1 resin part 12 and the polybutene-1 resin part 12 appears on the heat sealing edge, and the combination of the straight-chain low-density polyethylene resin part 11 and the polybutene-1 resin part 12 appears on the heat sealing edge. In comparison with the sealing strength in the width direction along the film flow direction (direction of the arrow A) of the heat sealed portion in the direction (X) perpendicular to the film flow direction (direction of the arrow A), the strength is larger when the combination of the straight-chain low-density polyethylene part 11 and the straight-chain low-density polyethylene part 11 appears or when the combination of the polybutene-1 resin part 12 and the polybutene-1 resin part 12 appears, while the strength is smaller when the combination of the straight-chain low-density polyethylene resin part 11 and the polybutene-1 resin part 12 appears. However, since the sealing strength is determined from the strength of the sealing edge, when the combination of the straight-chain low-density polyethylene resin part 11 and the polybutene-1 resin part 12 appears, the strength is small and hence peeling occurs. However, when the combination of the straight-chain low-density polyethylene resin part 11 and the straight-chain low-density polyethylene resin part 11 or the combination of the polybutene-1 resin part 12 and the polybutene-1 resin part 12 appears in the next instant, the sealing strength increases. Totally, the sealing strength in the width direction extending perpendicularly to the film flow direction (direction of the arrow A) of the heat sealed portion in the direction (Y) parallel to the film flow direction (direction of the arrow A) is stronger than that in the width direction along the film flow direction (direction of the arrow A) of the heat sealed portion in the direction (X) perpendicular to the film flow direction (direction of the arrow A). For appearance of such characteristics, as the straight-chain low-density polyethylene as the material of the inner layer 9, those having a density ranging from 0.915 to 0.950 are preferred, and the ratio of blending straight-chain low-density polyethylene and polybutene-1 is preferably within the range of 70:30 to 98:2 as described above. Outside these ranges, it is difficult to achieve the object of the present invention by realizing clear difference between the sealing strength in the width direction along the film flow direction (direction of the arrow A) of the heat sealed portion in the direction (X) perpendicular to the film flow direction (direction of the arrow A) and the sealing strength in the width direction extending perpendicularly to the film flow direction (direction of the arrow A) of the heat sealed portion in the direction (Y) parallel to the film flow direction (direction of the arrow A).

Utilizing the aforementioned nature, in the present embodiment, two film materials each having the bilayer structure are overlaid and the peripheries are heat sealed to produce the four-side sealed first and the second inner bags 7 and 8 having a rectangular planar shape. In such a case, the sealing strength in the width direction along the film flow direction (direction of the arrow A) of the heat sealed portion 13 in the direction (X) perpendicular to the film flow direction (direction of the arrow A), namely on the short side, is made smaller than the sealing strength in the width direction extending perpendicularly to the film flow direction (direction of the arrow A) of the heat sealed portion 14 in the direction (Y) parallel to the film flow direction (direction of the arrow A), namely on the longitudinal side, so that the sealed portion peels in the width direction of the heat sealed portion 13 on the short side upon increase in an inner pressure of the first and the second inner bags 7 and 8. More specifically, of the heat sealed portions 13 opposing each other on the short side, the widthwise dimension of one of the heat sealed portions 13 on the short side is made smaller than that of the other of the heat sealed portions 13 so that the sealed portion quickly peels in the width direction of the one of the heat sealed portions 13.

In brief, by forming a part having a narrow heat sealing width at an appropriate position in one of the heat sealed portions 13 opposing each other on the short side, the part having the narrow heat sealing width will quickly peel and provide an opening when the inner pressure is increased by application of the external pressure (force of pushing and pressing) on the first and the second inner bags 7 and 8.

In the first inner bag 7 manufactured in the manner as described above, a first reaction solution as a base material is introduced via one opening side of the first inner bag 7, and the first inner bag 7 is hermetically sealed, while in the second inner bag 8, a second reaction solution as a curing agent is introduced via one opening side of the second inner bag 8 and the second inner bag 8 is hermetically sealed. The first inner bag 7 containing the first reaction solution as the base material and the second inner bag 8 containing the second reaction solution serving as the curing agent are introduced into the main bag 1 via one opening side of the main bag 1, while one glass fiber cloth 15 having roughly a size of the inside of the outer bag 1 is put inside the main bag 1 so as to be along one side of the inner bag 7, and then one opening side of the main bag 1 is hermetically sealed. The sub bag 2 formed in continuation with the main bag 1 is provided for removing excess compounds of the first reaction solution and the second reaction solution contained therein at a time of usage.

Figure 8:
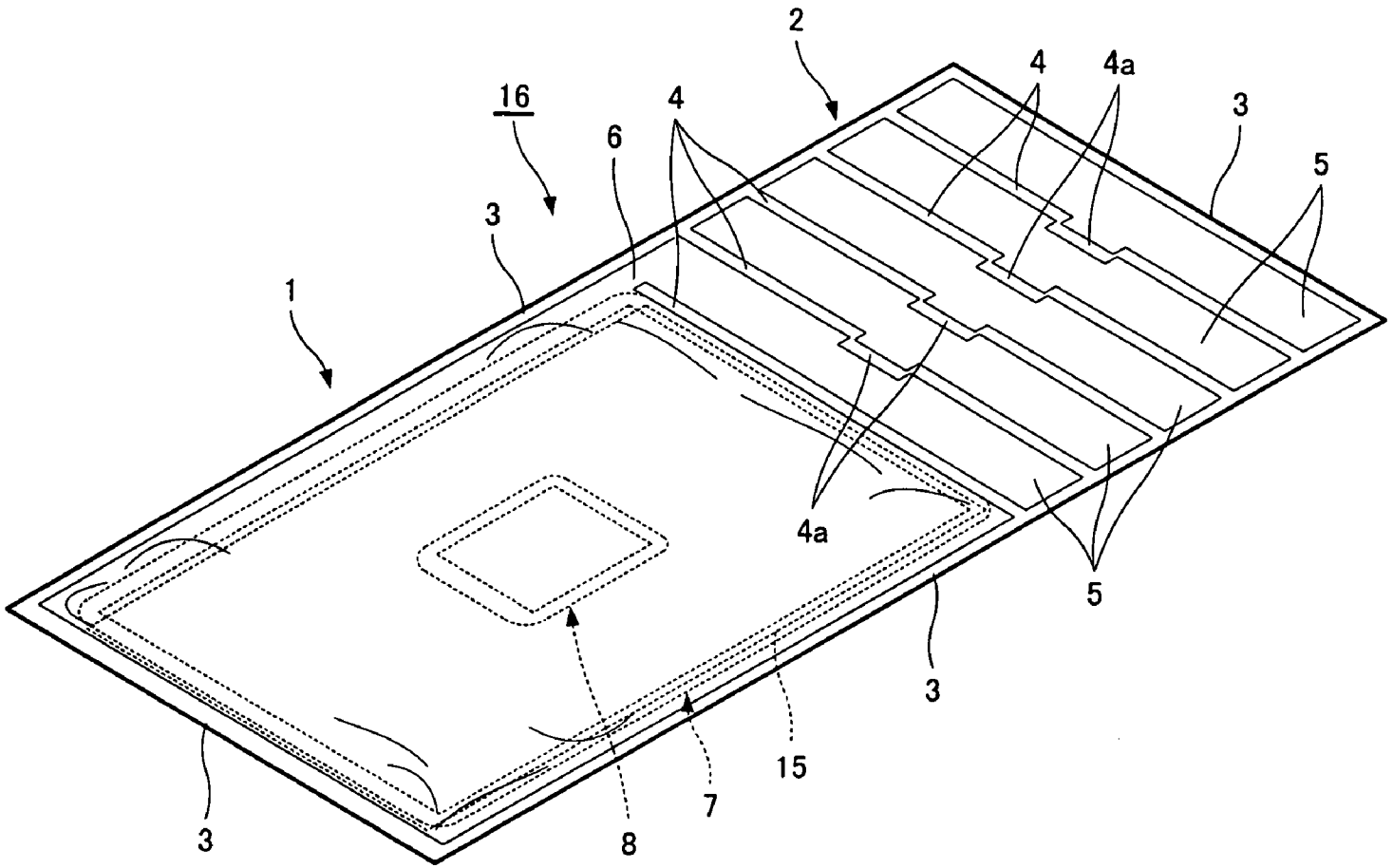
FIG. 8 shows a perspective view of the bridge sleeper supporting pad.
Figure 9:
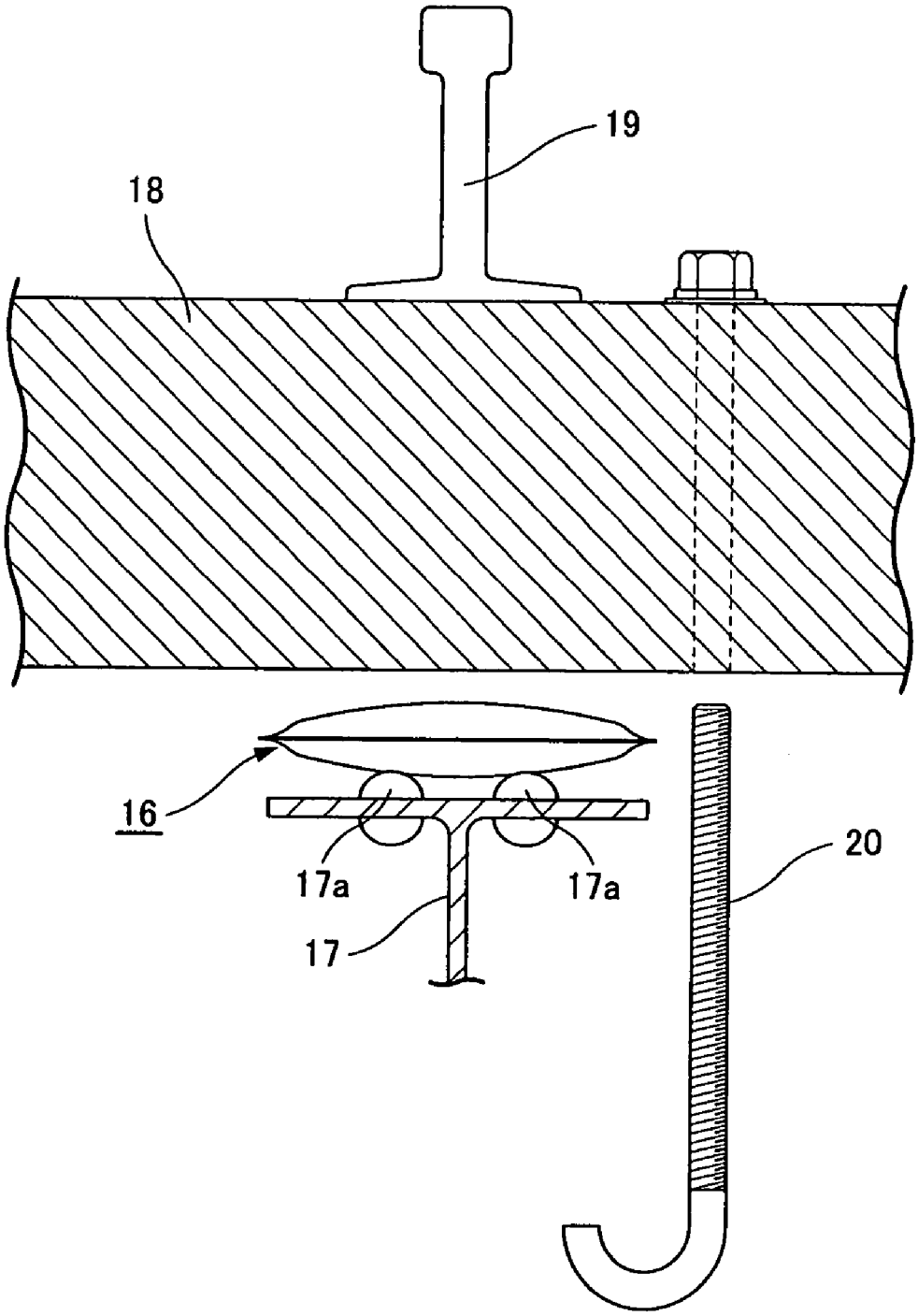
FIG. 9 shows a front view illustrating a state of the bridge sleeper supporting pad being used.
Figure 10:
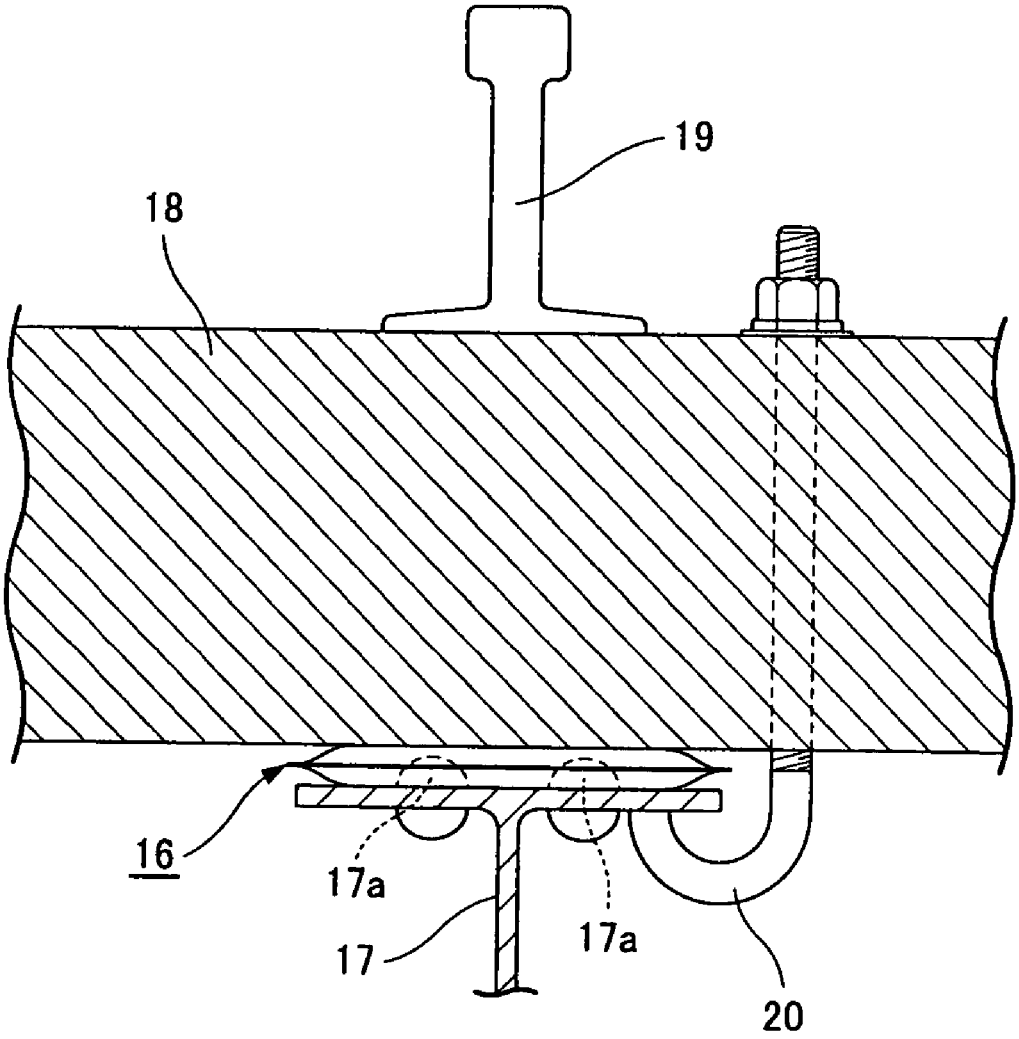
FIG. 10 shows a front view illustrating a state of the bridge sleeper supporting pad after completion of use.
Figure 11:
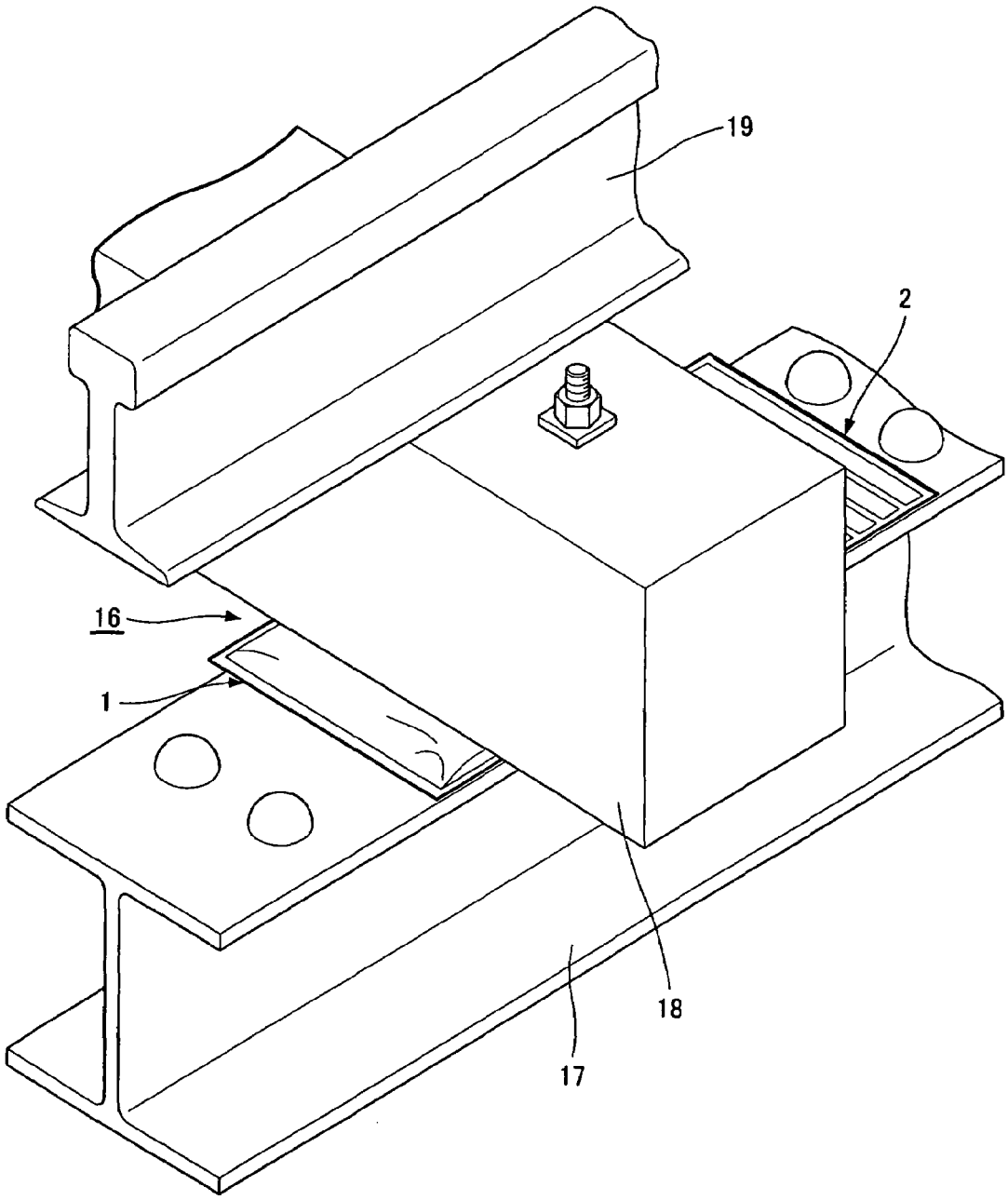
FIG. 11 shows a perspective view illustrating the state of the bridge sleeper supporting pad after completion of use.

A bridge sleeper supporting pad 16 shown in FIG. 8 made of the main bag 1 housing the first inner bag 7 containing the first reaction solution as the base material and the second inner bag 8 containing the second reaction solution as the curing agent is laid on a bridge beam 17 of an iron bridge so as to be located under a bridge sleeper 18 extending perpendicularly to a longitudinal direction of the bridge beam 17, as shown in FIGS. 9 to 11. When the bridge sleeper supporting pad 16 is placed on the bridge beam 17, an external pressure is applied from outside the main bag 1 of the bridge sleeper supporting pad 16 with the bridge sleeper 18 and the rail 19 floating, thereby causing the parts of the second inner bags 7 and 8 where the heat sealing width is narrow to peel and open, to mix the first reaction solution and the second reaction solution contained in the main bag 1, whereby the bridge sleeper supporting pad 16 is placed on a predetermined position of the bridge beam 17. Then on the bridge sleeper supporting pad 16, the bridge sleeper 18 and the rail 19 are placed, and the bridge sleeper 18 is secured onto the bridge beam 17 with a hook 20 hooked on the back face of the bridge beam 17. The sub bag 2 of the bridge sleeper supporting pad 16 projects from the bridge sleeper 18, and as the bridge sleeper 18 and the rail 19 are placed on the bridge sleeper supporting pad 16, the bridge sleeper supporting pad 16 is strongly pushed, and unnecessary compounds of the first reaction solution and the second reaction solution tend to flow into the sub bag 2. At this time, unnecessary compounds of the first reaction solution and the second reaction solution firstly flow into the compartment 5 located closest to the main bag 1 from the path 6. Then the unnecessary compounds flow from the compartment 5 located closest to the main bag 1 to the next compartment 5 as the sealed portion 4*a* in the middle part of the sealed portion 4 partitioning the neighboring compartments 5, 5 is peeled under a pressure by the unnecessary compounds of the first reaction solution and the second reaction solution. In this manner, the unnecessary compounds of the first reaction solution and the second reaction solution sequentially flow into the plurality of compartments 15 and the unnecessary compounds of the first reaction solution and the second reaction solution are removed from the main bag 1. With lapse of time in this condition, compounds of the first reaction solution and the second reaction solution in the bridge sleeper supporting pad 16 complete curing. That is, an interval between the bridge beam 17 and the bridge sleeper 18, namely a height of the rail 19 is adjusted by the thickness of a cured product of the compounds of the first reaction solution and the second reaction solution in the bridge sleeper supporting pad 16. The compounds of the first reaction solution and the second reaction solution wrap around the glass fiber cloth 15 so that the strength of the cured product of compounds increases. The bridge beam 17 has a protrusion 17*a* of the rivet in its upper end. The bridge sleeper supporting pad 16 has flexibility originating from the compounds existing therein in early stage of work, and the back face of the bridge sleeper supporting pad 16 conforms with the protrusion 17*a* by the weight of the bridge sleeper 18 and the rail 19 placed on the bridge sleeper supporting pad 16.

Concrete examples of the first reaction solution as the main material contained in the first inner bag 7 include compounds having epoxy group, compounds having isocyanate group, compounds of unsaturated diacid (glycol and maleic anhydride, fumaric acid), compounds such as acrylic acid or acrylate, compounds having silanol group, and compounds having amino group, and concrete examples of the second reaction solution as the curing agent contained in the second inner bag 8 include compounds such as polyamine, acid anhydride, polyphenol, or the like, compounds having hydroxyl group, compounds such as peroxide, compounds having isocyanate group, and compounds such as formaldehyde. And the second reaction solution suited for the first reaction solution contained in the first inner bag 7 is contained in the second inner bag 8, and for example, when a compound having epoxy group is used as the first reaction solution contained in the first inner bat 7, polyamine, acid anhydride, polyphenol or the like compound is used as the second reaction solution contained in the second inner bag 8; when a compound having isocyanate group is used as the first reaction solution, a compound having hydroxyl group is used as the second reaction solution; when a compound of unsaturated diacid (glycol and maleic anhydride, fumaric acid) or a compound such as acrylic acid or acrylate is used as the first reaction solution, peroxide or the like compound is used as the second reaction solution; when a compound having silanol group is used as the first reaction solution, a compound having isocyanate group is used as the second reaction solution; and when a compound having amino group is used as the first reaction solution, formaldehyde or the like compound is used as the second reaction solution. The combination of the first reaction solution as the base material to be contained in the first inner bag 7 and the second reaction solution as the curing agent to be contained in the second inner bag 8 is appropriately selected. In brief, the combination may be such that the first reaction solution as the base material and the second reaction solution as the curing agent mingle with each other and turn to resin and cure.

A quantity ratio between the first reaction solution as the base material and the second reaction solution as the curing agent differs depending on the kind of reaction solutions, and the sizes of the first inner bag 7 and the second inner bag 8 are determined in correspondence with the used quantity.

The sealed portion 4*a* is sealed using a sealing agent not spontaneously resolving by the contained compounds of the first reaction solution and the second reaction solution, and the sealing agent is appropriately selected from synthetic rubber adhesive, natural rubber adhesive, acrylic adhesive, percoat sealing agent, hot melt resin and the like. Instead of using such a sealing agent, an easy-to-peel tape maybe used to simplify the sealing. In the illustrated embodiment, the sealed portion 4*a* is formed to project toward the upstream compartment 5 in order to facilitate peeling by efficiently receiving the pressure by the unnecessary compounds of the first reaction solution and the second reaction solution flowing into the compartment 5.

Figure 12:
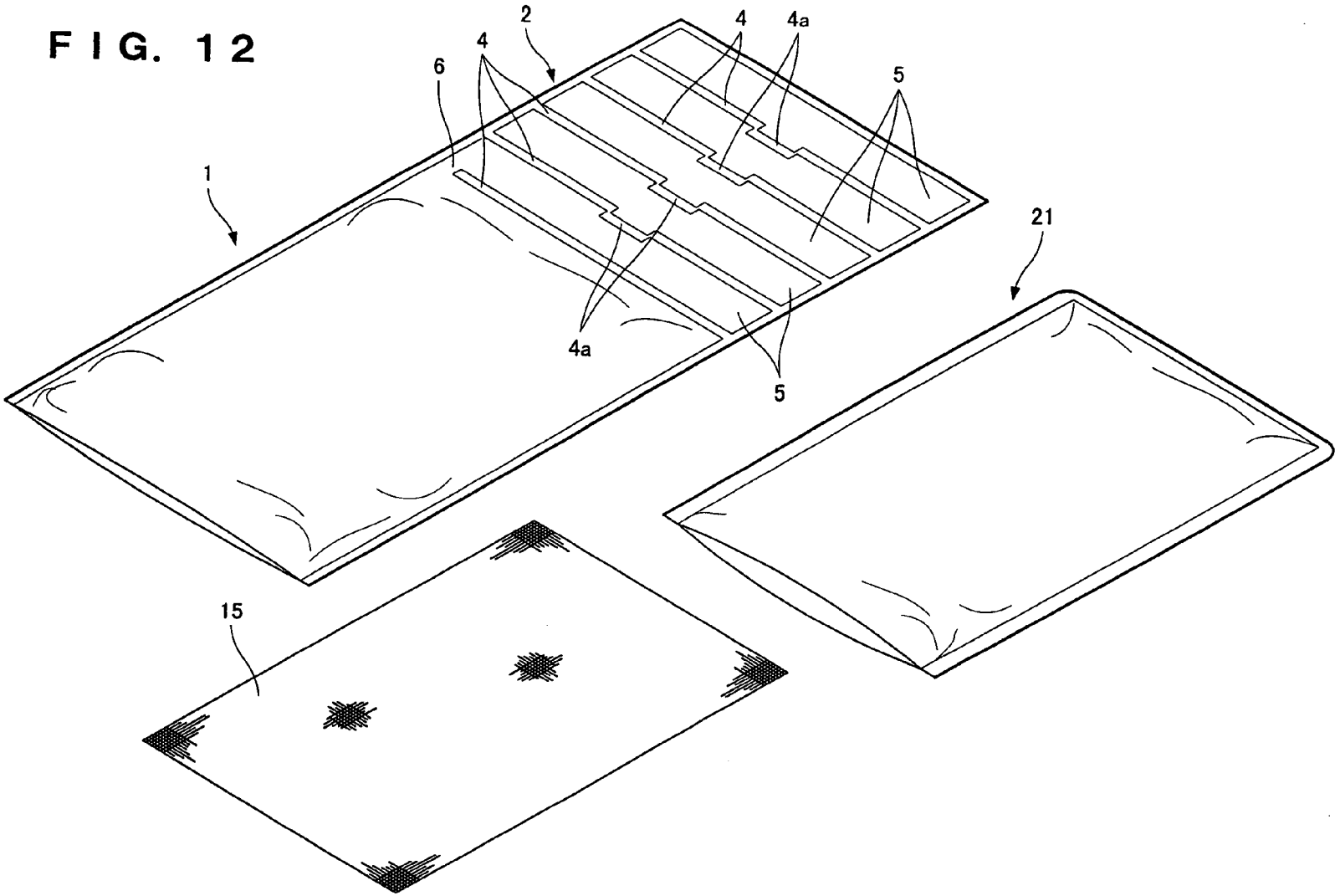
FIG. 12 shows exploded perspective views of a main bag, an inner bag, and a glass fiber cloth constituting a bridge sleeper supporting pad in a second embodiment of the present invention.

Next, the second embodiment shown in FIG. 12 will be explained. In the first embodiment, the first inner bag 7 containing the first reaction solution as the base material and the second inner bag 8 containing the second reaction solution as the curing agent are accommodated in the main bag 1, however, in the second embodiment, the first reaction solution as the base material or the second reaction solution as the curing agent is directly contained in the main bag 1, and only one inner bag 21 containing the second reaction solution as the curing agent or the first reaction solution as the base material is accommodated in the main bag 1. The inner bag 21 used in the second embodiment is also designed to be openable by application of the external pressure as is the case with the first and the second inner bags 7 and 8 of the first embodiment. Other configuration is as same as that of the first embodiment.

Two embodiments have been described in the above, and it is also possible to accommodate an inner bag containing a curing accelerator in the main bag 1 as necessary. Also this inner bag is designed to be openable by application of the external pressure as is the case with the first and the second inner bags 7 and 8 of the first embodiment. In the first embodiment, the curing accelerator may be directly accommodated in the main bag 1.

Further, as a measure of opening the inner bag by the external pressure, a method of making a part having smaller strength in the sealed portion enclosing the inner bag and opening the part by the external pressure can be exemplified, as well as the method of using straight-chain low-density polyethylene and polybutene-1 as described above, and thus the measure is not limited to the method of using straight-chain low-density polyethylene and polybutene-1.

Figure 13:
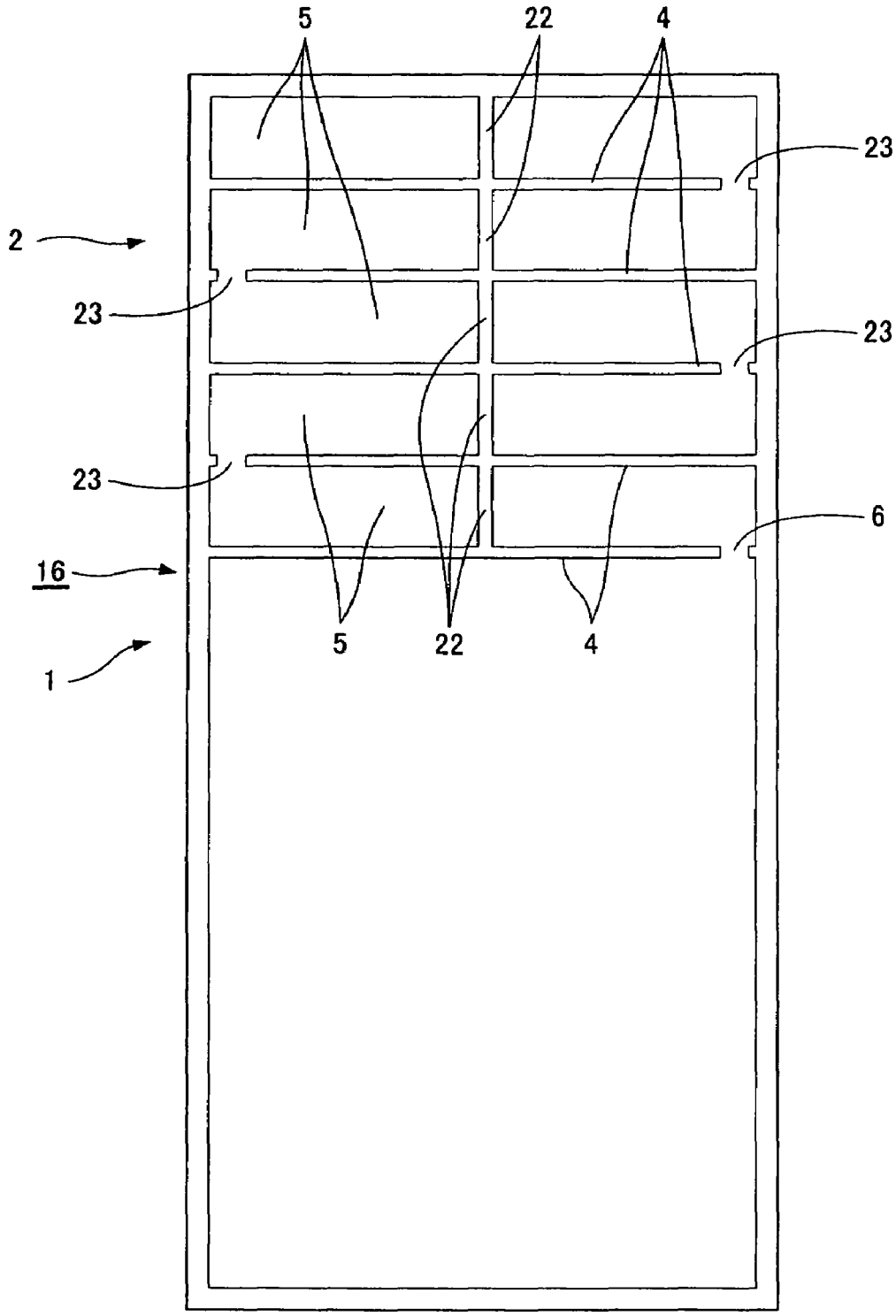
FIG. 13 shows a plan view of a bridge sleeper supporting pad in a third embodiment of the present invention.

Next, a third embodiment shown in FIG. 13 will be explained. In the third embodiment, like the sub bag 2 explained in the first embodiment, at the middle part in the short side direction of the main bag 1 of the each compartment 5 partitioned in the longitudinal direction of the main bag 1, the each compartment 5 is divided into two halves by an easily peeling sealed portion 22 as is the case with the sealed portion 4*a*, and neighboring compartments 5, 5 communicate each other via a path 23 formed in the sealed portion 4 on the downstream position of the each compartment 5. In the third embodiment, the easily peeling sealed portion 4*a* is absent in the middle part of the sealed portion 4 partitioning the neighboring compartments 5, 5. Therefore, in the bridge sleeper supporting pad 16 of the third embodiment, unnecessary compounds of the first reaction solution and the second reaction solution from the main bag 1 pass through the path 6, and an inner pressure thereof opens the sealed portion 22 in the each compartment 5, whereby the unnecessary compounds of the first reaction solution and the second reaction solution flow into the plurality of compartments 5.

Figure 14:
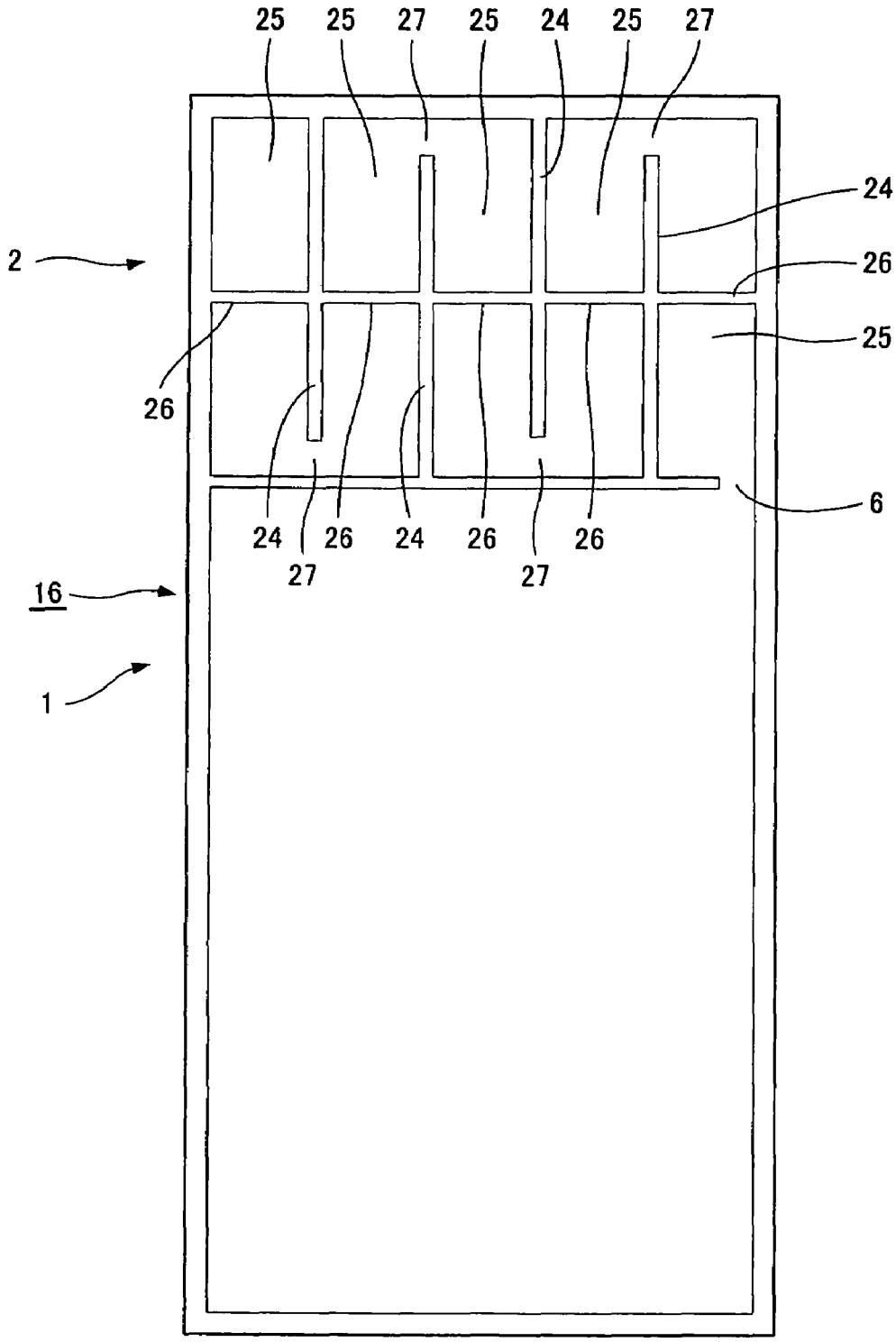
FIG. 14 shows a plan view of a bridge sleeper supporting pad in a fourth embodiment of the present invention.

Next, a fourth embodiment shown in FIG. 14 will be explained. In the fourth embodiment, an interior of the sub bag 2 is formed with a plurality of compartments 25 partitioned by sealed portions 24 in the short side direction of the main bag 1, and the each compartment 25 is divided by an easily peeling sealed portion 26 as is the cases with the sealed portion 4*a* and the sealed portion 22, with the each component 25 being divided into two halves at the middle part in the longitudinal side direction of the main bag 1 of the each compartment 25. Also, neighboring compartments 25, 25 communicate each other via a path 27 formed in the sealed portion 24 on downstream side of the each compartment 25. Therefore, in the bridge sleeper supporting pad 16 of the fourth embodiment, unnecessary compounds of the first reaction solution and the second reaction solution from the main bag 1 pass through the path 6, and an inner pressure thereof opens the sealed portion 26 in the each compartment 25, whereby the unnecessary compounds of the first reaction solution and the second reaction solution flow into the plurality of compartments 25.

Further, in the above third and fourth embodiments, like the second embodiment, the first reaction solution as the base material or the second reaction solution as the curing agent may be directly contained in the main bag 1, and only one inner bag containing the second reaction solution as the curing agent or the first reaction solution as the base material may be accommodated in the main bag 1.

Figure 15:
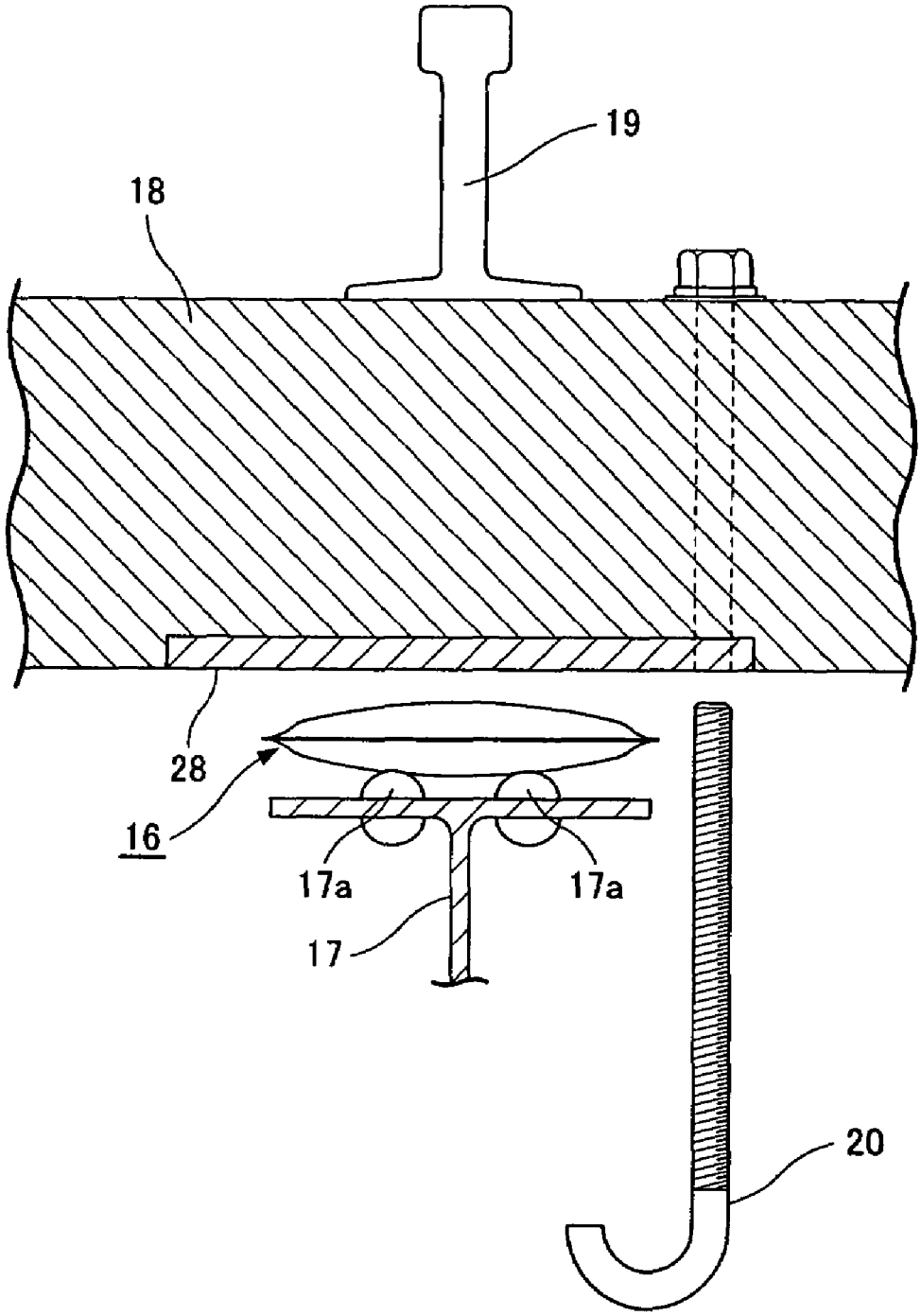
FIG. 15 shows a front view illustrating a state of a bridge sleeper supporting pad being used for describing another embodiment of the present invention.
Figure 16:
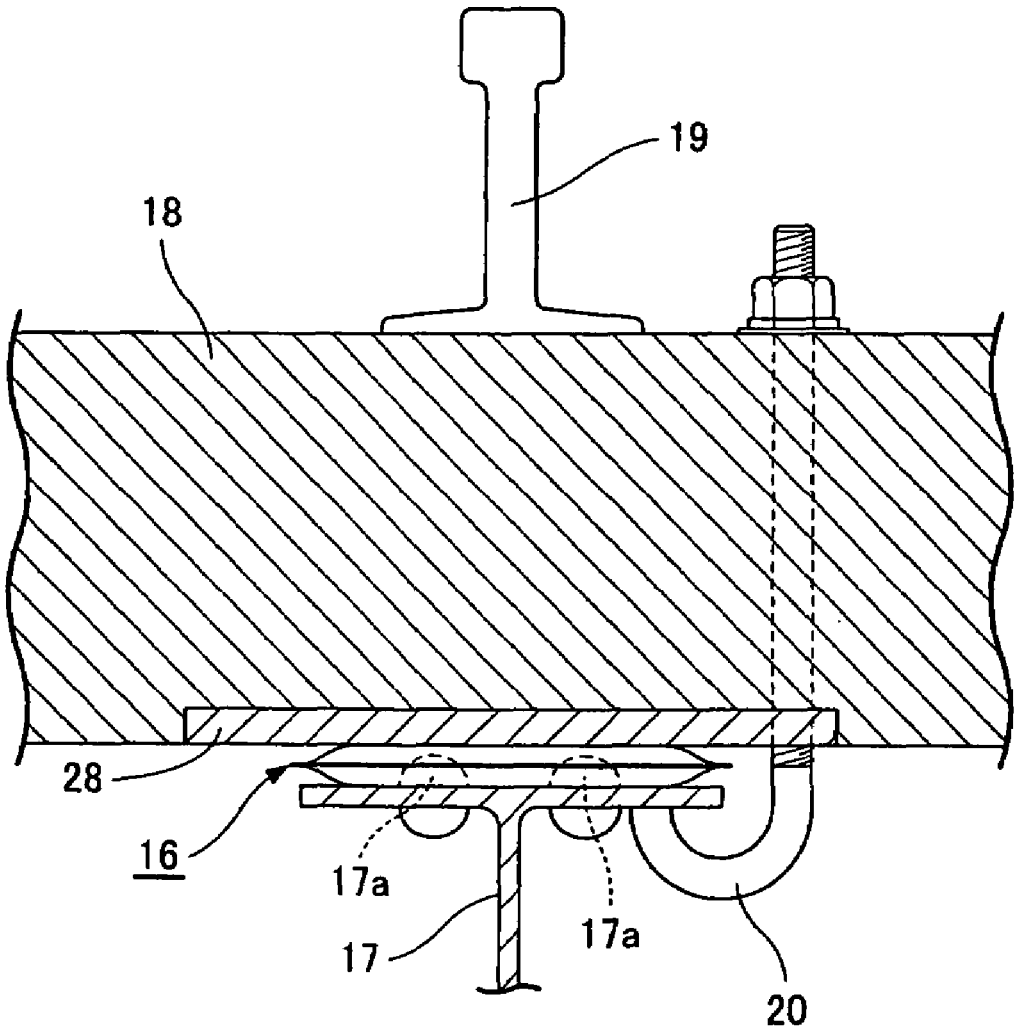
FIG. 16 shows a front view illustrating the state of the bridge sleeper supporting pad after completion of use.

The aforementioned bridge sleeper supporting pad 16 may be used in the states shown in FIGS. 15 and 16, as well as the case of newly providing a rail 19 in the manner as shown in FIGS. 9 to 11. That is, in the use states shown in FIGS. 15 and 16, at a position on the back face of the bridge sleeper 18 where a bridge beam 17 is to be laid, an enhancing plate 28 made of wood is fitted so that a substantially half of its thickness protrudes downward from the bridge sleeper 18. And when the enhancing plate 28 decays from the back side, the decayed part is removed and the back face of the enhancing plate 28 is made flat, and in this condition, the bridge sleeper supporting pad 16, is interposed between the bridge bream 17 and the enhancing plate 28.

What is claimed is:

1. A bridge sleeper supporting pad in combination with a bridge beam having a projection of a rivet on a top end of the bridge beam and a bridge sleeper extending perpendicularly to a longitudinal direction of the bridge beam, said pad comprising:

a main bag comprising a synthetic resin sheet and containing a first reaction solution as a base material;

an inner bag disposed in the main bag and comprising a synthetic resin sheet, the inner bag containing a second reaction solution as a curing agent for mixing with the first reaction solution, and at least a part of the inner bag being operable under application of external pressure from outside the main bag; and a sub bag operatively communicating with the main bag and including a plurality of neighboring compartments such that a first said compartment is adjacent the main bag, each neighboring compartment is operatively communicable with an adjacent compartment, and adjacent neighboring compartments are partitioned by a sealed portion at least partly having an easily peeled sealed portion there along said sealed portion;

the bridge sleeper supporting pad supported by the bridge beam and the bridge sleeper disposed on the bridge sleeper supporting pad so that the sub bag of the bridge sleeper supporting pad projects from the bridge sleeper;

the weight of the bridge sleeper and rail on the bridge sleeper supporting pad pushes unnecessary compounds of the first reaction solution and the second reaction solution to sequentially flow into the plurality of compartments in the sub bag while a pressure of the unnecessary compounds opens the easily peeled sealed portion.

* * * * *